United States Patent [19]

Ragan

[11] Patent Number: 5,002,221

[45] Date of Patent: Mar. 26, 1991

[54] STACKED PIZZA PIE BOX

[76] Inventor: Philip J. Ragan, R.D. #2 E. Creek Rd., Beaver Dams, N.Y. 14812

[21] Appl. No.: 350,047

[22] Filed: May 10, 1989

[51] Int. Cl.[5] ..... B65D 5/48

[52] U.S. Cl. ..... 229/120; 229/120.32; 229/191; 229/906; 229/DIG. 14; 493/59; 493/69; 493/912

[58] Field of Search ..... 229/120, 191, 120.19, 229/120.32, 902, 906, DIG. 14, 190; 426/115, 119, 130; 493/59, 69, 160, 162, 912

[56] References Cited

U.S. PATENT DOCUMENTS

| | | | |
|---|---|---|---|
| 1,168,565 | 1/1916 | Rosenwald | 229/120.32 |
| 1,857,033 | 5/1932 | Sherman | 229/120.32 |
| 1,981,187 | 11/1934 | Nuckols | 229/120.32 |
| 2,732,121 | 1/1956 | McGovern | 229/191 |
| 2,758,774 | 8/1956 | Grunert et al. | 229/190 |
| 3,013,710 | 12/1961 | Kronson et al. | 229/190 |
| 3,086,690 | 4/1963 | Beck | 229/120.32 |
| 3,184,136 | 5/1965 | Forbes, Jr. | 229/191 |
| 3,211,282 | 10/1965 | Hennessey | 220/441 |
| 3,379,304 | 4/1968 | Mertz | 229/120.32 |

FOREIGN PATENT DOCUMENTS

| | | | |
|---|---|---|---|
| 78693 | 6/1951 | Norway | 229/120.32 |

*Primary Examiner*—Gary E. Elkins
*Attorney, Agent, or Firm*—Ralph R. Barnard

[57] ABSTRACT

A rectangular box for transporting multiple pizza pies, with one or more pairs of short horizontal cuts in each corner, such that they form shelf supports when poked into the box. The shelf supports are configured such that they provide ventilation for the pizzas, and allow the shelves and pizzas to be easily removed from the box. The box, a cardboard version of it, and the method for making it are all disclosed.

In addition, a particular type of box, with a fold-over top with flaps on three sides of the box, which fit into the box as the top folds down, and a separator stand in the center of each pizza pie for support of the pie above, are disclosed.

11 Claims, 3 Drawing Sheets

Figure 1
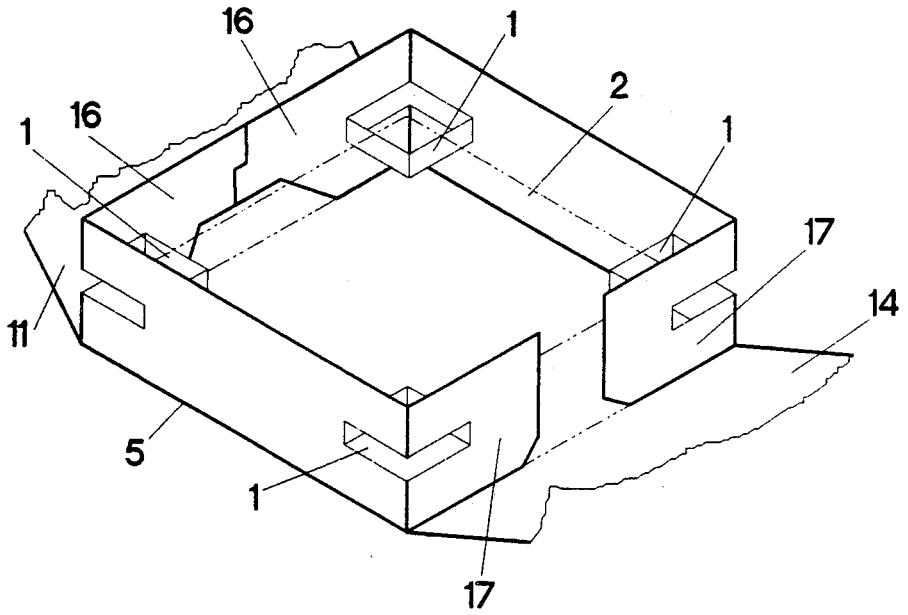
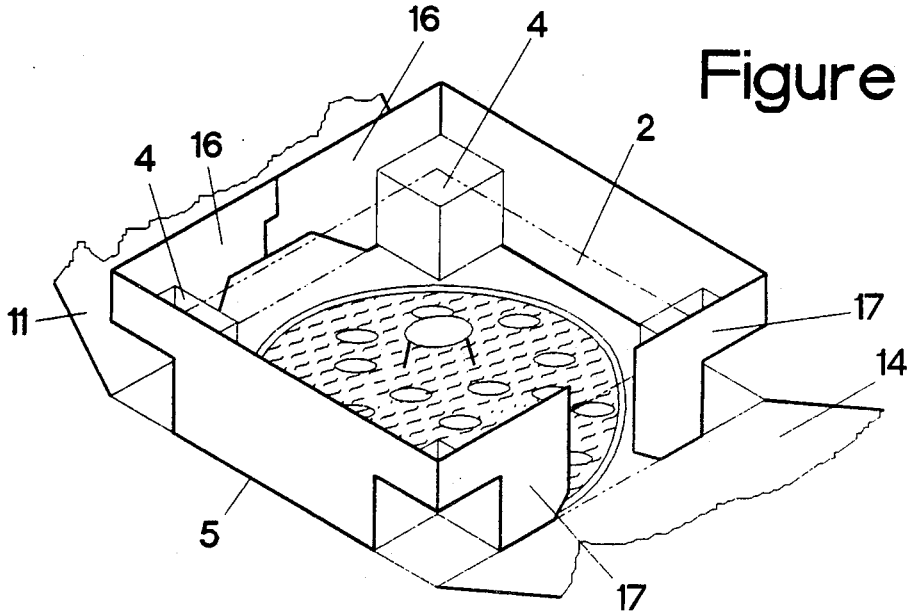
Figure 2
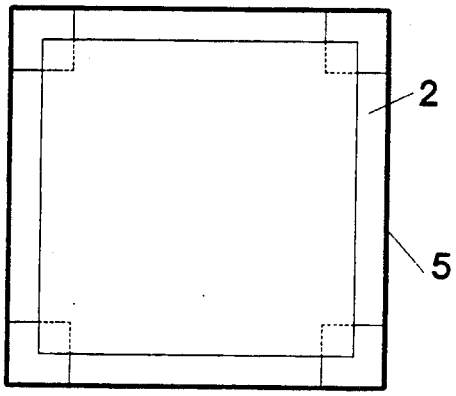
Figure 3

STACKED PIZZA PIE BOX

FIELD OF THE INVENTION

The present invention generally relates to the field of packaging crushable food products and more particularly to the filed of a new and improved box and method for vertically stacking pizza type pies in a box for handling and delivery.

BACKGROUND OF THE INVENTION

Packaging of crushable pizza type pies and similar products has gone through a change over time both with respect to rigidity of the package and the need for packaging two or more pizza type pies in support of a sales campaign wherein the price essentially requires a two or more for one package of what is essentially a dimensionally similar product. One of the most important developments in the packaging of pizzas has been the separator stand which is placed on the surface of the meat, cheese, etc. of the pizza for the purpose of holding the top of the package away from the edible pizza itself. As time has passed, the packaging for marketing pizzas has taken an increased significance in assuring customer satisfaction. In short, the cost of boxing pizza type pies is becoming more significant and also the customer wants a package that serves the purpose of maintaining the heated product in the best condition before serving.

One of the facets of maintaining the pizza in edible condition involves the ventilation of the hot pizza. The moisture must be handled and the temperature of the product must be maintained at the proper level as long as possible. When pizza type products entered a phase when they were being sold on a two for one basis cost, design and utility of the box became a more important factor. Moreover, the most efficient packaging of more than one physically similar pizza type pie to be delivered to the same customer for a single price raises the question of the identification of a method of packaging that solves the inherent packaging concerns.

Efficient use of space, the cost, the ease of handling, and the maintenance of the quality of the pizza type pies determine the packaging requirements.

SUMMARY OF THE INVENTION

The present inventor determined that the method of packaging and the storage box should utilize vertical stacking of more than one pizza type pies of similar size. He was concerned that the pizza type pies not be crushed, that the pizza type pies be properly ventilated so that the hot pizza type pies would not become soggy as they cooled and that the present technology for packaging of food with biodegradable materials be applicable to the solution, if desired.

The present inventor took a cardboard type box having a rectangular outside dimension and the height suitable to more than one pizza pie in a stacked relationship and, on each of the four corners adjacent the designated location for a shelf, cut two parallel horizontal lines across the corners to provide a pokein internal shelf support in a position on each corner of the box for each of the pizza type pie shelves above the first pizza pie to serve as a support for the said pizza shelf for the next higher stacked pizza type pie with said pokein shelf support also providing an opening to the outside of the package for the pizza type pies to ventilate while at the same time holding the said shelf as a part of the teachings of the present invention the design of the shelves is to provide dimensions less than the size of the box so they will fit loosely on the shelf supports for the purpose of providing vertical ventilation access between the pizza storage levels and allow the pizza box user to lift easily the shelf and pizza type pie out of the box on the shelf.

The method as described, allows the cardboard type pizza box to include a conventional fold over flap on one side thereof and a conventional fold over top on the other side thereof with flaps on three sides of the top fitting into the box as the top folds down and a separator stand in the center of each pizza pie giving support to the shelf and/or box top above the said pizza type pie.

This method of packaging and the implementing box utilizes vertical stacking of more than one pizza type pie of similar size. The pizza type pies will not be crushed and each of the pizza type pies will be properly ventilated to the outside so that each of the hot pizza type pies will not become soggy and that the present technology for packaging of food with biodegradable materials is applicable to the solution, if desired.

Accordingly, it is a primary object to provide a new and improved method of packaging and a new and improved storage box which utilizes vertical stacking of plural pizza type pies.

It is still another object of the present invention to provide a new and improved method of packaging and a new and improved storage box which utilizes vertical stacking of plural pizza type pies wherein the pizza type pies will not be crushed and each of the pizza type pies will be properly ventilated to the outside so that each of the hot pizza type pies will not become soggy.

It is an additional object of the present invention to provide a new and improved method of packaging and a new and improved storage box which utilizes vertical stacking of plural pizza type pies wherein the present technology for packaging of food with biodegradable materials is applicable to the solution, if desired.

It is still another object of the present invention to provide a new and improved method of packaging and a new and improved storage box which utilizes vertical stacking of plural pizza type pies which includes a conventional fold over flap on one side thereof and a conventional fold over top on the other side thereof with flaps on three sides of the top fitting into the box as the top folds down and a separator stand in the center of each pizza pie giving support to the shelf and/or box top above each of the said pizzas.

These and other objects, features and advantages of the present invention should become apparent from the following description when taken in conjunction with the accompanying drawings in which;

FIG. 1 shows a cardboard type box for transporting two pizza type pies in stacked relationship with the sides of the box having been cut in the four corners to provide four pokein internal shelf supports for a shelf for the upper pizza type pie all in accordance with the teachings of the present invention.

FIG. 2 shows a cardboard type box for transporting two pizza type pies in stacked relationship with the sides of the box having been cut in the four corners in an alternate manner as shown in FIGS. 7 and 8 to provide four pokein internal shelf supports for a shelf for the upper pizza type pie all in accordance with the teachings of the present invention.

FIG. 3 shows a top view of a shelf and shelf supports as depicted in the boxes of FIGS. 1 and 2 all in the accordance with the teachings of the present invention and showing that the shelf for the second stacked pizza type pie is smaller than the box and provides room for ventilation from one level to another as well as leaving room for the user's fingers so that the shelf can function as a tray when removing the pizza type pie from the box.

Figure 4:
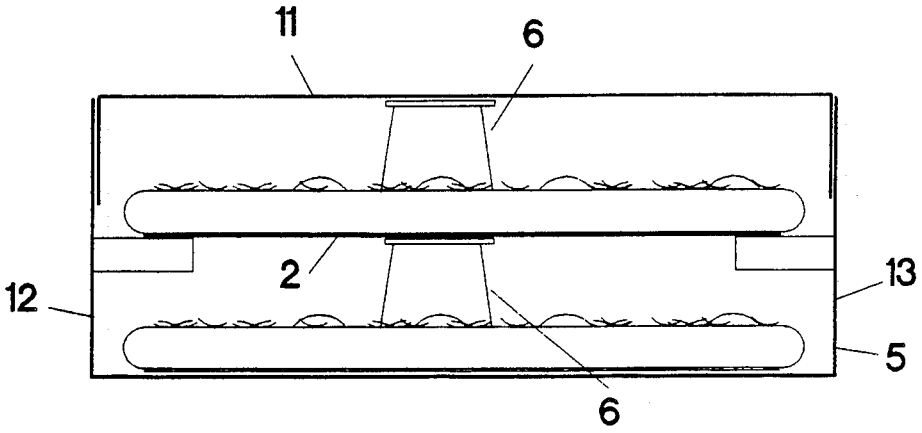

FIG. 4 shows a cross section of a box of the type such as shown in FIGS. 1 and 2, but with a top; it includes pizzas on both the bottom and shelf levels and a separator stand in the center of each of the two stacked pizza type pies all in accordance with the teachings of the present invention.

Figure 5:
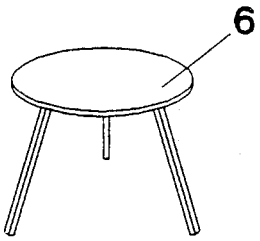

FIG. 5 shows one detailed form of a separator stand usable to implement the teachings of the present invention.

Figure 6:
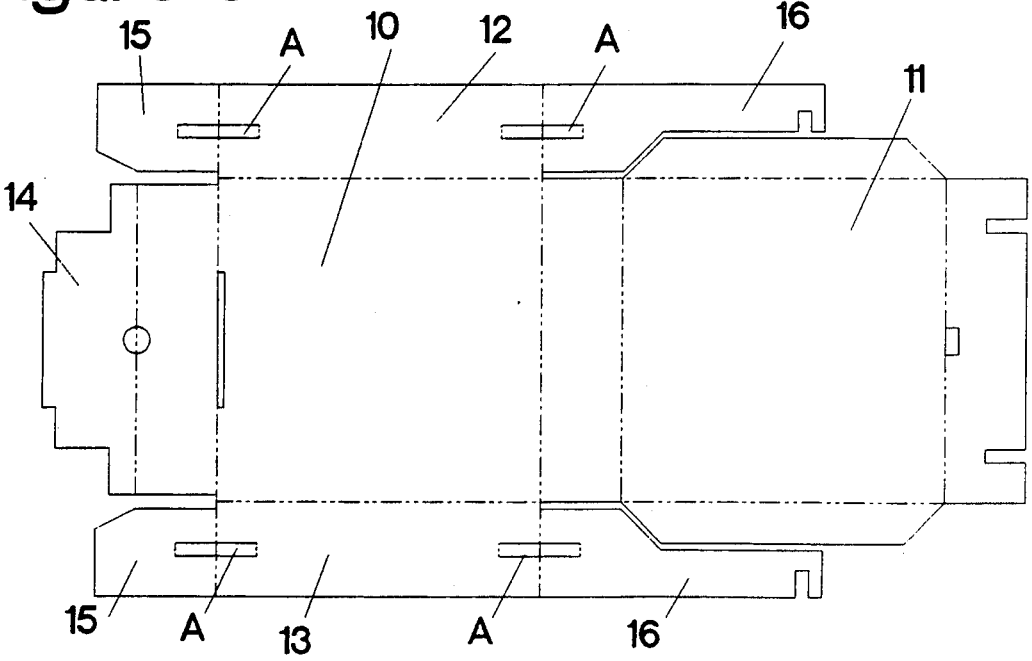

FIG. 6 shows a unfolded cardboard type box incorporating the parallel cuts in the four corners for providing pokein internal shelf supports in accordance with the teachings of the present invention when the parallel cuts for each corner of the box provide the relatively narrow connected joist like cardboard ribbons to function as four internal shelf supports.

Figure 7:
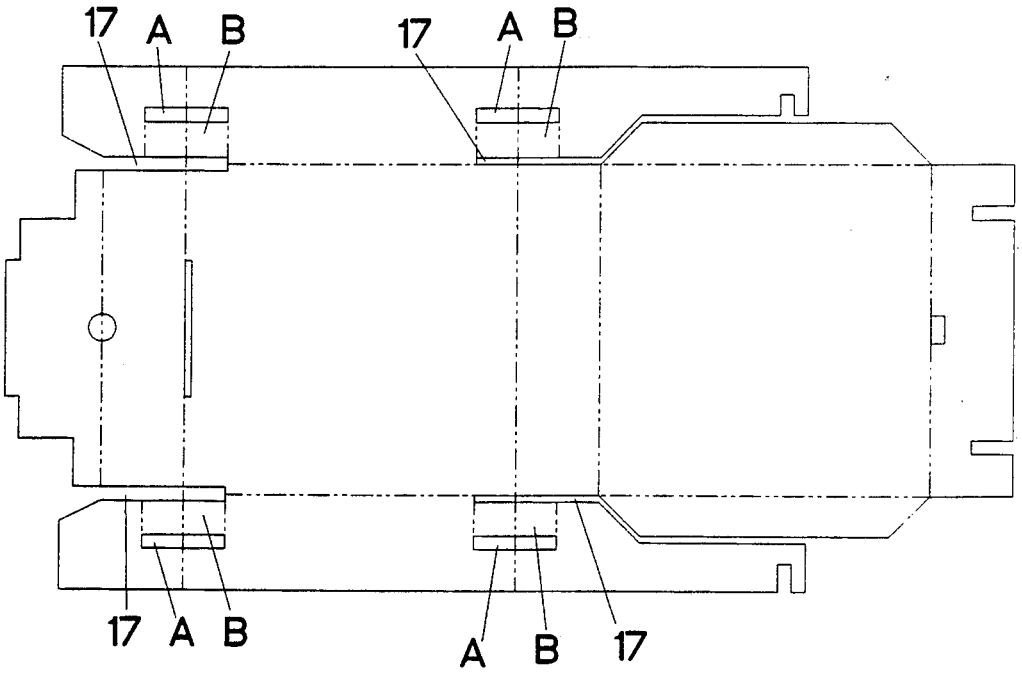

FIG. 7 shows a unfolded cardboard type box incorporating the parallel cuts in the four corners for providing pokein internal shelf supports in accordance with the teachings of the present invention when the parallel cuts for each corner of the box provide either the relatively narrow connected joist like cardboard ribbons to function as four internal cantilevered shelf supports of cross section (A) or the connected joist like ribbons of large cross section of the four internal corner shelf supports is made up of both cross section Part (A) and cross section Part (B).

Figure 8:
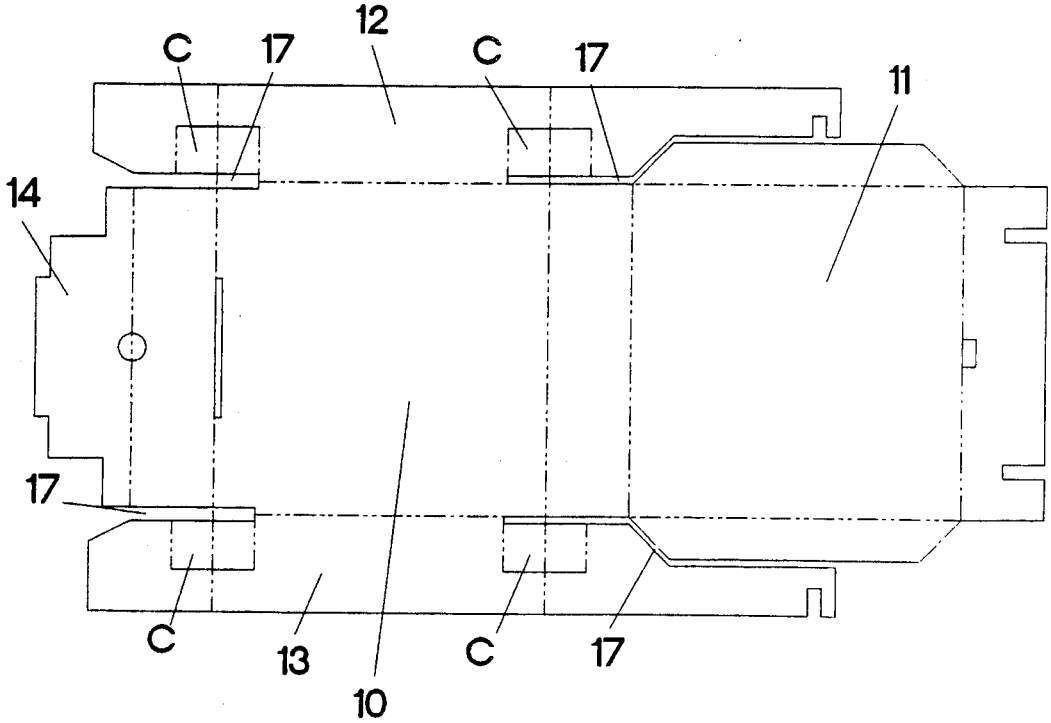

FIG. 8 shows an unfolded cardboard type box incorporating parallel cuts in the four corners for providing pokein internal shelf supports in accordance with the teachings of the present invention when the parallel cuts for each corner of the box provide connected joist like ribbons of large cross sections C for an internal corner shelf support in each corner of the box.

DETAILED DESCRIPTION

FIG. 1 shows the cardboard type box of FIG. 6 partially assembled to illustrate the formation of the four pokein internal corner supports (1) in each corner of the box (5) to support the pizza shelf (2) supporting the upper pizza type pie.

Two parallel cuts are shown in each corner and the cardboard poked into the box to form a cantilevered shelf support (1) comprising two connected joist like cardboard ribbons. The width of the ribbon in some working examples has been satisfactory at approximately one-half inch. The material out of which the box is fabricated would be important in selecting the usable width of the ribbon. Four shelf supports (1) are required, as shown, at each shelf level of stacked pizza type pies above the bottom level.

In FIG. 3, the shelf (2) fits on top of the four shelf supports (1) as shown and is smaller than the rectangular dimensions of the box to provide ventilating communication between the two areas storing the hot stacked pizza type pies. Similarly, the rectangular holes in the sides of the cardboard box at the corners give open communication between the outside of the box and the two levels for the hot pizza type pies inside the box. If ventilation during the cooling of the two pizza type pies is not available to the outside of the box, the moisture which appears in the cooling atmosphere in the box and in the pizza type pies causes them to become more soggy than if adequate ventilation were present.

In FIG. 1, except for the pokein internal shelf supports (1) as identified and their interaction with the appropriately sized shelf (2), the cardboard box as shown is of standard construction except that the dimensions are such that it will fit the size pizza type pie as to area and be high enough to enclose at least two pizza pies in stacked relationship on shelf (2). If more than two stacked pies are desired, the height of the box is increased accordingly and in each of the four corners of the box there is cut an appropriately coarse of connected joist like cardboard ribbon. Referring to FIG. 6, it should be understood that the cutting being described herein is most likely to be made with appropriately located knives and dies while the cardboard material is in a flat condition as shown.

The technology of manufacturing cardboard boxes has reached a high level and those skilled in the art would have no trouble modifying the current machinery to make the flattened out box material as shown in FIG. 6 with its pattern of cardboard material cuts, holes and creases. For reference, the bottom is identified as (10) and the fold over top is identified as (11). One side is identified as (12), and a second side is identified as (13). The fold over flap is identified as (14). The fold over flap (14) cooperates with fold over flaps (15) to form a third side. Finally, fold over flaps (16) cooperate with fold over top (11) to form the fourth side of the box (5) shown in FIGS. 1, 2, 3, 4, 6, 7, and 8. Various embodiments of the present invention are shown herein as they relate to a variety of corner shelf support designs in cooperation with the shelf to allow for the stacking of pizza type pies all in accordance with the teachings of the present invention. However, it should be emphasized that the fold over top and fold over flap and cooperating flaps are of conventional design and variation of these parts can be made without departing from the teachings of the present invention.

In FIGS. 1, 2, 3, 4, 5, 6, 7, and 8 the similar functional components are given the same numbers for identification. The teachings of the present invention include the method and box structure necessary for vertically stacking pizza type pies in the same box without crushing them.

The present invention as described, requires: (1) the making of a cardboard type box as shown in the figures having a rectangular outside dimension and the height suitable to more than one pizza pie in a stacked relationship and (2) on each of the four corners adjacent the designated location for a shelf, the cutting of parallel horizontal lines across the corners to provide a pokein internal shelf support in a position on each corner of the box for each of the pizza type pie shelves above the first pizza pie to serve as a support for the said pizza shelf for the next higher stacked pizza type pie. In FIG. 1, the parallel cuts when poked in form a cantilevered shelf support (1) comprising two connected joist like cardboard ribbons and the cross section is based on parallel cuts as shown in FIG. 6. In FIG. 2, the pokein shelf supports (4) are based on parallel cuts shown in FIGS. 7 and 8. Referring now to FIG. 6, the box making technology provides the relatively slender parallel cuts shown. If one wanted to make a box that would function like either FIG. 1 or 2, one would make an additional parallel cut shown at (17) so that the box when it is made up can function to provide the pokein shelf support (4) as shown in FIG. 2 or the narrower pokein shelf support (1) embodiment of FIG. 1. The pokein shelf supports (4) could also be obtained by making the parallel cuts as shown in FIG. 8, wherein one cut is made at (17) and the other cut would be made approximately at the same location as before.

For example, FIG. 6, shows two parallel cuts in each corner, FIG. 7, shows three parallel cuts in each corner and FIG. 8 shows two parallel cuts in each corner. The cut at (17) is shown in both FIGS. 7 and 8 as wider than the other two cuts, but the cutting width is not critical. However, it is important that the cross section (A) as shown in FIG. 6, be large enough to support adequately support the vertically stacked pizza type pies on each pokein corner support (1). The wider pokein corner support (4) of FIG. 2 could be better adapted for circular pizza type pies for the lower stacked position under particular circumstances, whereas the smaller cross section (A) of FIG. 1 could be considered optimum for pizza type pies of rectangular outside dimension in both the lower and the upper levels. The box of FIG. 7, can be used to provide a pokein corner support (1) of the narrower cross section (A) by poking in only the narrow cross section (A) or a pokein corner support (4) of a larger cross section (A plus B) by poking in both parts. It is important that the shelf (2) as shown in FIG. 3 is smaller in dimension than the box (5) to provide the communication between each level of stacked pizza type pies and the outside for the purpose of preventing the formation of moisture in the pie itself. In FIG. 2, a pizza is shown on the bottom of the box and also shown is a separator stand (6) for holding a shelf (2) (to be inserted on the corner supports) away from the pizza. FIG. 4 presents a cross section of a box (5) of the type using corner supports (1) [of the type shown in FIG. 1], for the purpose of illustrating two stacked pizzas using the shelf (2) and corner supports in combination according to the teachings of the present invention. Also, two separator stands (6) are shown, one supporting the shelf (2) and the other supporting the top (11). The separator stands (6) as shown may not be necessary in every application; such devices will add significantly to the ability of the stacked pizza pies to be delivered without damage when boxed in accordance with the teachings of a the present invention. FIG. 5 shows a separator stand of the kind which is now in use in the field by others for keeping the top of a pizza box from touching the edible product in a pizza. It was not known heretofore that the separator stand could be used as an important element in vertically stacking pizza type pies by also holding up the shelf (2) for the upper stacked pizza. The number of separator stands which will be determined by how many pizza type pies are placed in stacked relationship. It is clear that the stand must be made of material consistent with the fact that does touch the edible product.

While the inventor has disclosed his invention as using cardboard boxes it should be clear that the boxes (5) could be made of other materials known to those skilled in the art, which materials have the necessary characteristics including those which would allow for the construction of pokein internal shelf supports for each of the corners for each level of stacked pizza type pies beyond the first level. It may be preferable to use biodegradable materials however, the teachings of the present invention would have high utility in any event.

While only two levels of pizza type pies are shown in describing the present invention in reference to the figures, it should be clear that more than two levels of pizza type pies may be stacked using the same method and technology described herein by providing an additional course of four internal pokein shelf supports at the proper height in the corners of the box with a shelf (2) being placed on each one. Referring again to FIGS. 1 and 2, the shelf (2) is shown in dotted form for the purpose of imagining the presence of the shelf (2) and seeing through the shelf to the bottom of the box (5) and depicting the appearance of the boxes in accordance with the teachings of the present invention.

The outside dimension or dimension of the round or square pizza type pies as distributed to the public varies and of course the dimension of the box technology taught herein will vary accordingly.

The foregoing description has been directed to particular embodiments of the invention in accordance with the requirements of the Patent Statutes for the purposes of illustration and explanation. It will be apparent, however, to those skilled in this art that many modifications and changes will be possible without departure from the scope and spirit of the invention. It is intended that the following claims be interpreted to embrace all such modification.

I claim:

1. A cardboard type box for transporting more than one pizza type pie in a stacked relationship, comprising:

(1) a floor having generally rectangular dimensions;

(2) four side walls, each of which is integrally connected with said floor, and each of said side walls forming an intersection with two other of said side walls, such that each of said intersections forms a corner of said box;

(3) each of said side walls being of a height suitable to contain more than one of said pizza type pies in a stacked relationship, there being a lowest one of said stacked pizza type pies and at least one next higher of said stacked pizza type pies;

(4) at least one set of pokein internal shelf supports, each set comprising two short parallel horizontal lines being cut across each of said four corners, each of said sets of pokein internal shelf supports being of sufficiently small size to allow for easy lifting of the next lower pizza type pie out of the box, the number of sets of said pokein internal shelf supports being one less than the number of pizza type pies to be transported in said box; and (5) wherein each set of pokein internal shelf supports provides support for a pizza shelf for the next higher stacked pizza type pie while also providing an opening for the pizza type pies to ventilate.

2. The cardboard type pizza box for transporting plural pizza type pies in a stacked relationship as claimed in claim 1, wherein each of said shelves has dimensions less than the size of the box so that said shelves will fit loosely on said set of internal corner shelf supports for the purpose of providing vertical ventilation access between the pizza storage levels and allow the pizza box user easily to lift said shelves and said pizza type pies out of the box.

3. The cardboard type pizza box for transporting plural pizza type pies in a stacked relationship as claimed in claim 2, wherein the cardboard type pizza box contains a fold over flap on one side thereof and a fold over top on the other side thereof with flaps on three sides of the top fitting into the box as the top folds down.

4. The cardboard type pizza box for transporting plural pizza type pies in a stacked relationship as claimed in claim 3, wherein a separator stand is placed in the center of each pizza type pie to give support to said shelves or box top above the pizza type pies.

5. A box for transporting more than one pizza type pie in a stacked relationship, comprising:

(1) a floor having generally rectangular dimensions;

(2) four side walls, each of which is integrally connected with said floor, and each of said side walls forming an intersection with two other of said side walls, such that each of said intersections forms a corner of said box;

(3) each of said side walls being of a height suitable to contain more than one of said pizza type pies in a stacked relationship, there being a lowest one of said stacked pizza type pies and at least one next higher of said stacked pizza type pies;

(4) at least one set of pokein internal shelf supports, each set comprising two short parallel horizontal lines being cut across each of said four corners, each of said sets of pokein internal shelf supports being of sufficiently small size to allow for easy lifting of next lower pizza type pie out of the box, the number of sets of said pokein internal shelf supports being one less than the number of pizza type pies to be transported in said box; and (5) wherein each set of pokein internal shelf supports provides support for a pizza shelf for the next higher stacked pizza type pie while also providing an opening for the pizza type pies to ventilate.

6. The box for transporting plural pizza type pies in a stacked relationship as claimed in claim 2, wherein each of said shelves has dimensions less than the size of the box so that said shelves will fit loosely on said shelf supports for the purpose of providing vertical ventilation access between the pizza storage levels and allow the pizza box user easily to lift said shelves and said pizza type pies out of the box.

7. The box for transporting plural pizza type pies in a stacked relationship as claimed in claim 6, wherein the pizza box contains a fold over flap on one side thereof and a fold over top on the other side thereof with flaps on three sides of the top fitting into the box as the top folds down.

8. The pizza box for transporting plural pizza type pies in a stacked relationship as claimed in claim 7, wherein a separator stand is placed in the center of each pizza type pie to give support to said shelves or box top above the pizza type pies.

9. The method of making a box for carrying and transporting plural stacked pizza type pies comprising the steps of:

(1) making a box with four corners having a rectangular outside dimension, said box of a height suitable to enclose more than one pizza pie in a stacked relationship, there being a lowest one of said stacked pizza type pies and at least one next higher of said stacked pizza type pies;

(2) cutting short parallel horizontal lines across each of the four corners to provide sets of pokein internal shelf supports, the number of sets of pokein internal shelf supports being one less than the number of pizza type pies to be carried and transported, wherein each set of pokein internal shelf supports provides support for a pizza shelf for the next higher stacked pizza type pie; and (3) said pokein holes for said set of pokein internal shelf supports providing openings for the pizzas to ventilate to the outside while said set of pokein internal shelf supports hold up said shelf for the next higher stacked pizza type pies.

10. The method of making a box for carrying and transporting plural stacked pizza type pies as set forth in claim 9, further including the additional method step of making said shelves to be placed upon each set of pokein internal shelf supports, said shelves having dimensions slightly less than the dimensions of the box for the purpose of providing vertical ventilation excess between pizza storage levels and allowing the pizza box user easily to lift said shelves and pizza type pies out of the box.

11. The method of making a box for carrying and transporting plural stacked pizza type pies as set forth in claim 10, further including the additional step of fitting the box for stacked pizza type pies with a fold over flap on one side thereof and a fold over top on the other side thereof with flaps on three sides of the top fitting into the box as the top folds down.

* * * * *